US008408950B2

(12) United States Patent
Jeon et al.

(10) Patent No.: US 8,408,950 B2
(45) Date of Patent: Apr. 2, 2013

(54) FEMALE CONNECTOR ASSEMBLY

(75) Inventors: Sung-Won Jeon, Ulsan (KR); Jeong-Wook Choi, Ulsan (KR); O-Tae Kwon, Ulsan (KR)

(73) Assignee: Kum Co., Ltd., Ulsan (KR)

( * ) Notice: Subject to any disclaimer, the term of this patent is extended or adjusted under 35 U.S.C. 154(b) by 0 days.

(21) Appl. No.: 13/260,478

(22) PCT Filed: Mar. 9, 2010

(86) PCT No.: PCT/KR2010/001463

§ 371 (c)(1),
(2), (4) Date: Nov. 8, 2011

(87) PCT Pub. No.: WO2010/110540

PCT Pub. Date: Sep. 30, 2010

(65) Prior Publication Data

US 2012/0064752 A1 Mar. 15, 2012

(30) Foreign Application Priority Data

Mar. 24, 2009 (KR) ..... 10-2009-0025013

(51) Int. Cl.
*H01R 13/514* (2006.01)

(52) U.S. Cl. ..... 439/752; 439/595

(58) Field of Classification Search ..... 439/752, 439/595, 744

See application file for complete search history.

(56) References Cited

U.S. PATENT DOCUMENTS

| | | | | |
|---|---|---|---|---|
| 5,037,336 | A * | 8/1991 | Betsui | 439/752 |
| 5,501,606 | A | 3/1996 | Oda et al. | |
| 5,558,526 | A | 9/1996 | Nagamine | |
| 6,165,011 | A * | 12/2000 | Fukuda | 439/595 |
| 6,890,204 | B2 | 5/2005 | Yamawaki | |
| 7,381,091 | B2 * | 6/2008 | Menez | 439/595 |
| 2012/0064752 | A1 * | 3/2012 | Jeon et al. | 439/345 |

FOREIGN PATENT DOCUMENTS

| | | |
|---|---|---|
| JP | 05-205814 | 8/1993 |
| KR | 10-0241301 | 2/2000 |
| KR | 10-0499751 | 7/2005 |

* cited by examiner

*Primary Examiner* — James Harvey
(74) *Attorney, Agent, or Firm* — Sherr & Jiang, PLLC

(57) ABSTRACT

An assembly of a female connector, including: a housing including a casing having an opening formed in front of the casing so that a male connector is inserted in the opening, an internal body that includes one or more terminal-accommodating holes formed in the internal body and protrudes from a rear side of the casing towards a front of the housing, and a plurality of first combining portions that extend from the internal body to the front of the housing, each of the plurality of first combining portions including an extension groove formed in one side of each first combining portion so as to communicate with the one or more terminal-accommodating holes.

6 Claims, 6 Drawing Sheets

FEMALE CONNECTOR ASSEMBLY

CROSS REFERENCE TO PRIOR APPLICATIONS

This application is a National Stage Patent Application of PCT International Patent Application No. PCT/KR2010/001463 (filed on Mar. 9, 2010) under 35 U.S.C. §371, which claims priority to Korean Patent Application No. 10-2009-0025013 (filed on Mar. 24, 2009), which are all hereby incorporated by reference in their entirety.

TECHNICAL FIELD

The present invention relates to an assembly of a female connector, and more particularly, to an assembly of a female connector in which a terminal is secured in a housing and which can be combined with a male connector.

BACKGROUND ART

Electric connectors generally include a housing in which at least one conductive terminal is disposed. A terminal of electric connectors is electrically connected to an additional electrical element, such as a wire. Electric connectors are classified into female connectors and male connectors, wherein the female and male connectors are always disposed in units of pair and are combined with each other.

When the terminal is improperly disposed in the housing, the quality of electric connection is lowered. For example, when the terminal is not fully inserted in the housing while an assembled female connector is transferred to a final assembly line or while the male and female connectors are assembled with one another, or when the terminal is shaken or is detached from the housing while the electric connector is used, the terminal is improperly disposed in the housing.

In order to solve the problems, in these days, a terminal position assurance (TPA) that detects whether the terminal is not fully inserted in the housing is disposed in a female connector of a vehicle. However, when the TPA is additionally disposed in the female connector of the vehicle, the number of elements of the female connector increases. Thus, it is very inconvenient to perform assembling of the female connector. Also, when the TPA is additionally disposed in the female connector of the vehicle, the TPA should be precisely secured in the housing after the position of the terminal is precisely detected. However, since a direction in which the terminal is inserted in the housing and a direction in which the TPA is inserted in the female connector of the vehicle, are opposite to each other, an assembly of a female connector according to the related art has a disadvantage that the TPA cannot be easily secured in the female connector of the vehicle.

DISCLOSURE

Technical Problem

The present invention provides an assembly of a female connector in which a terminal may be conveniently and stably secured.

Technical Solution

According to an aspect of the present invention, there is provided an assembly of a female connector, including: a housing including a casing having an opening formed in front of the casing so that a male connector is inserted in the opening, an internal body that includes one or more terminal-accommodating holes formed in the internal body and protrudes from a rear side of the casing towards a front of the housing, and a plurality of first combining portions that extend from the internal body to the front of the housing, each of the plurality of first combining portions including an extension groove formed in one side of each first combining potion so as to communicate with the one or more terminal-accommodating holes, wherein a first securing protrusion is disposed in the extension groove, and a first groove that is formed in one side of a terminal inserted through the one or more terminal-accommodating holes is secured in the first securing protrusion; and a front holder including a front portion having the number of a plurality of insertion holes corresponding to the number of the one or more terminal-accommodating holes formed in the front portion and a plurality of second combining portions corresponding to the number of the first combining portions that extend from the front portion towards a rear of the front holder, include a second securing protrusion that is formed to correspond to the first securing protrusions in an opposite direction to a direction in which the first securing protrusion is formed, in such a way that a second groove formed in the other side of the terminal is secured on an end part of each second combining portion, wherein, when the front holder is inserted in the opening and then is slid on a left or right side of each first combining portion so that the terminal-accommodating holes and the plurality of insertion holes are aligned with one another, the first securing protrusion and the second securing protrusion secure the first groove and the second groove, respectively, and the front holder is combined with the first combining portion.

The assembly of the female connector may further include an inner seal that is inserted in an outer surface of the internal body, is pressurized by the front holder and seals a space formed between the male connector and the outer surface of the internal body to be waterproofed.

Two or more terminal-accommodating holes and two or more insertion holes that correspond to one another, and two or more first combining portions and two or more second combining portions that correspond to one another may be disposed in two stairs in a vertical direction, and the front holder may further include a support portion that is formed between the second combining portions disposed in two stairs in a vertical direction, extends from the front portion to the rear of the front holder and supports a space formed between the first combining portions.

Each of the first combining portions may further include a first lateral plate disposed at one side of the first combining portion, and the front holder may further include a second lateral plate disposed in an opposite direction to a direction in which the first lateral plate is disposed, and when the front holder is slid on the left or right side of the first combining portion and is combined with the first combining portion, the first lateral plate and the second lateral plate may protect lateral sides of the first combining portion and the front holder.

Advantageous Effects

As described above, in the assembly of the female connector according to the present invention, firstly, a terminal may be primarily secured by a first securing protrusion that is disposed on a housing and then may be secondarily secured by a second securing protrusion disposed on a front holder by sliding the front holder in left or right direction of a casing so that the front holder may serve as a terminal position assurance (TPA) and the terminal may be conveniently and stably secured.

Secondly, when the assembly of the female connector (FC) is manufactured in its primarily-secured state and is secondarily secured by sliding the front holder on the spot, the number of processes is reduced, and workability is improved.

Thirdly, when the assembly of the female connector (FC) is secondarily secured by sliding the front holder, an interference between the front holder and the terminal occurs. Thus, when the assembly of the female connector (FC) is not properly secured due to the interference, it may be determined whether the terminal is inserted in each of a plurality of terminal-accommodating holes halfway, and the front holder may serve as a TPA.

Fourthly, when an inner seal is used, the inner seal is waterproof, and the air-tight state of the assembly of the female connector (FC) is maintained, and short that is a main defect in applying an electric current may be prevented from occurring due to terminal detachment or shake.

DESCRIPTION OF DRAWINGS

The above and other features and advantages of the present invention will become more apparent by describing in detail exemplary embodiments thereof with reference to the attached drawings in which.

BEST MODE

The present invention will now be described more fully with reference to the accompanying drawings in which exemplary embodiments of the invention are shown. Before describing the present invention, all terms or words used herein should not be interpreted only in commonly used dictionaries but should be interpreted as having a meaning or concept that is consistent with their meaning in the context of the technical spirit of the present invention based on a principle that the inventor may properly define concepts of the terms so as to describe his/her own invention in a best manner.

Thus, embodiments described herein and the drawings are just exemplary embodiments and do not represent all of technical sprits of the present invention. Thus, it would be appreciated by those skilled in the art that various equivalents and changes may be made at the time of filing the present application in these exemplary embodiments without departing from the principles and spirit of the invention, the scope of which is defined in the claims and their equivalents.

Figure 1:
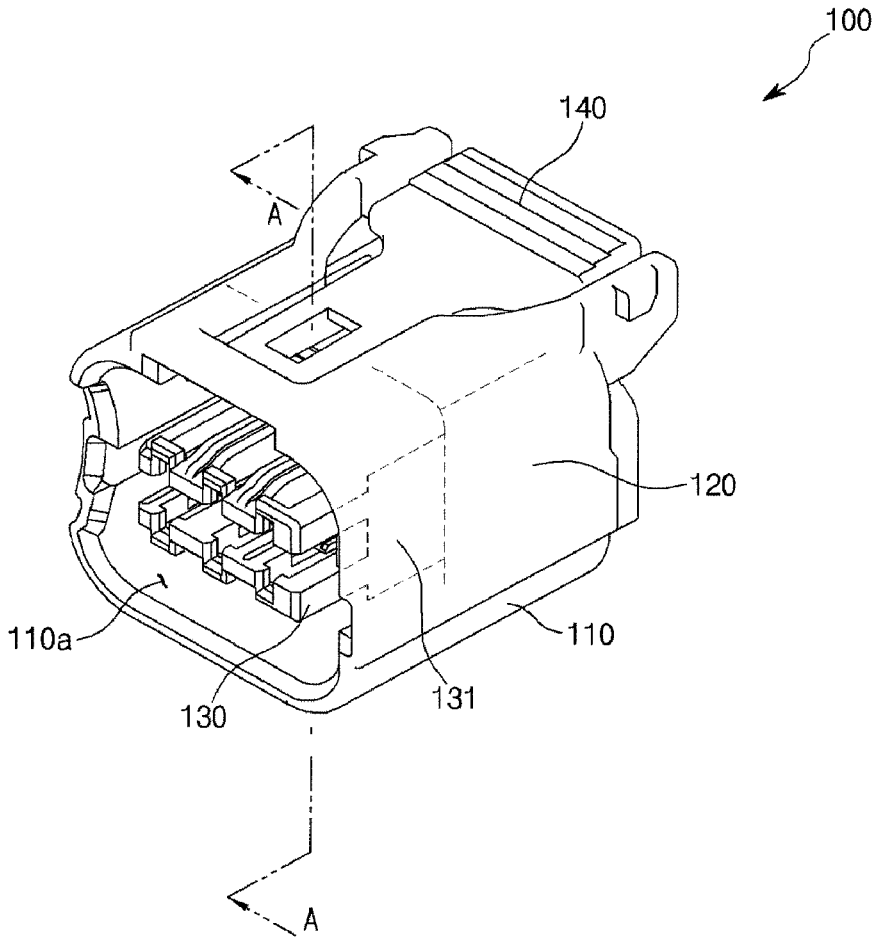
FIGS. 1 through 3 are a perspective view, a rear view, and a cross-sectional view of a housing according to an embodiment of the present invention.
Figure 2:
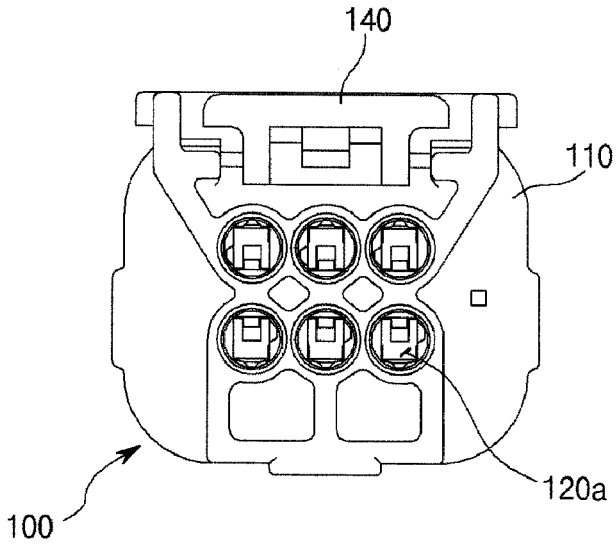
Figure 3:
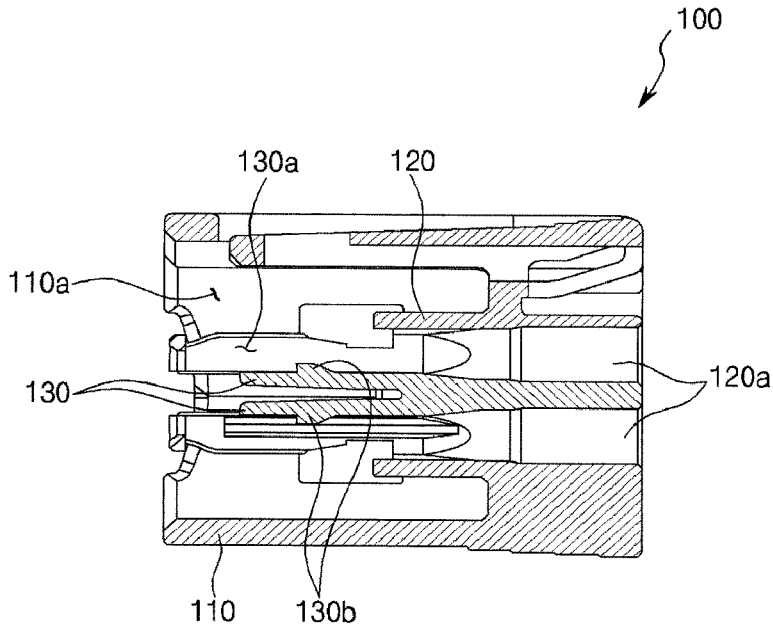

An assembly of a female connector (FC) according to an embodiment of the present invention includes a housing 100 and a front holder 200. FIGS. 1 through 3 are a perspective view, a rear view, and a cross-sectional view of the housing 100 according to an embodiment of the present invention.

Figure 6:
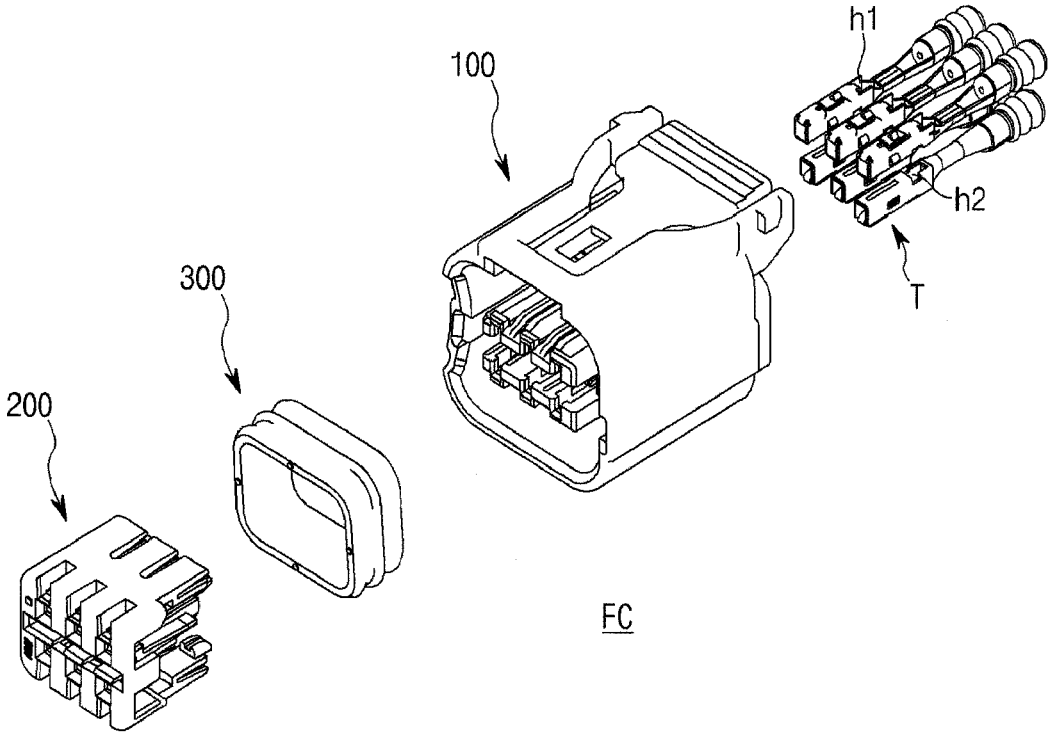
FIG. 6 is an exploded perspective view of an assembly of a female connector according to an embodiment of the present invention.

The housing 100 has a similar shape to a hexahedron and includes a casing 110, an internal body 120, and a plurality of first combining portions 130. An opening 110*a* is formed in front of the casing 110, and a male connector (MC) is inserted in the opening 110*a*. The internal body 120 includes at least one terminal-accommodating hole 120*a* formed therein and protrudes from a rear side of the casing 110 towards the front of the housing 100. Referring to FIG. 2, three terminal-accommodating holes 120*a* are formed in upper and lower portions of the internal body 120, respectively, and total six terminal-accommodating holes 120*a* are formed in the internal body 120. Obviously, the number of terminal-accommodating holes 120*a* may be modified in various combinations, such as up and down and right and left arrangement, if necessary. Each of the first combining portions 130 extends from the internal body 120 to the front of the housing 100. In addition, an extension groove 130*a* is formed in one side of the first combining potion 130 so as to communicate with the terminal-accommodating holes 120*a*. A first securing protrusion 130*b* is disposed in the extension groove 130*a*, and a first groove h1 formed in one side of a terminal T inserted through the terminal-accommodating holes 120*a* is secured in the first securing protrusion 130*b*. Referring to FIG. 6, the first groove h1 is formed in one side of the terminal T, and a second groove h2 is formed in the other side of the terminal T.

Referring to FIGS. 1 through 3, three terminal-accommodating holes 120*a* are formed in upper and lower portions of the internal body 120, respectively, and total six terminal-accommodating holes 120*a* are formed in the internal body 120, and two first combining portions 130 extend from the upper and lower portions of the internal body 120, respectively. In addition, the first combining portion 130 that is disposed in the upper portion of the internal body 120 includes the extension groove 130*a* and the first securing protrusion 130*b* that are formed on a top surface of the first combining portion 130, whereas the first combining portion 130 that is disposed in the lower portion of the internal body 120 includes the extension groove 130*a* and the first securing protrusion 130*b* that are formed on a bottom surface of the first combining portion 130. A groove is formed between the first combining portions 130 and thus, a support portion 230 that will be described below is supported by the groove. A male connector securing member 140 is disposed at one side of the housing 100 and secures the male connector (MC) to be inserted in the opening 110.

Figure 4:
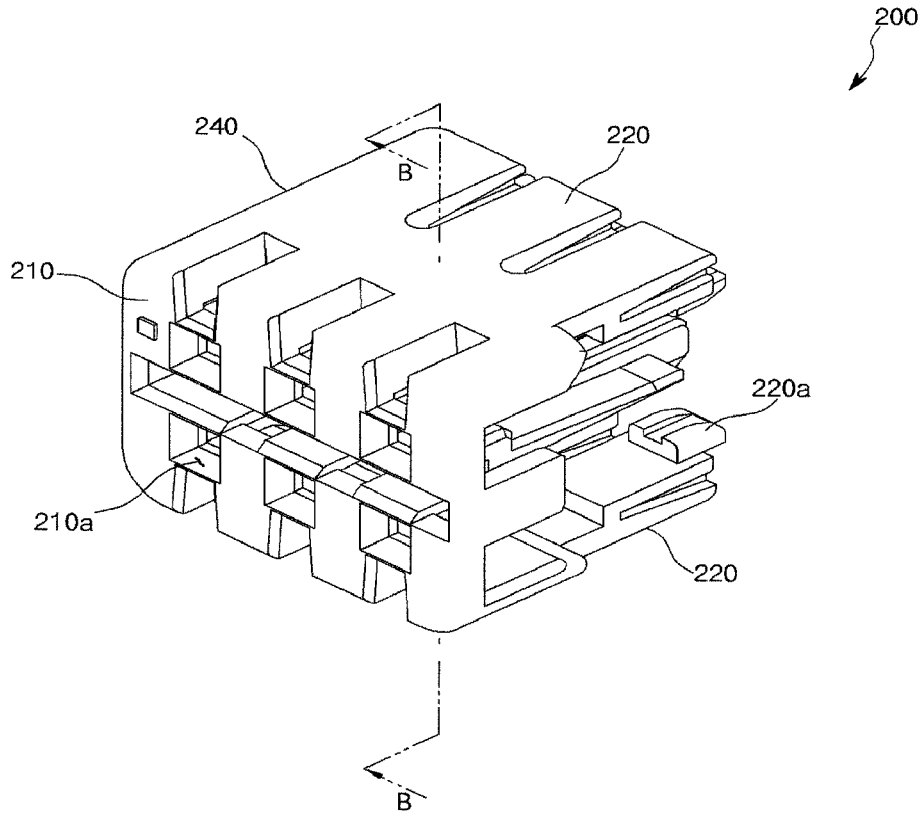
FIGS. 4 and 5 are a perspective view and a cross-sectional view of a front holder according to an embodiment of the present invention.
Figure 5:
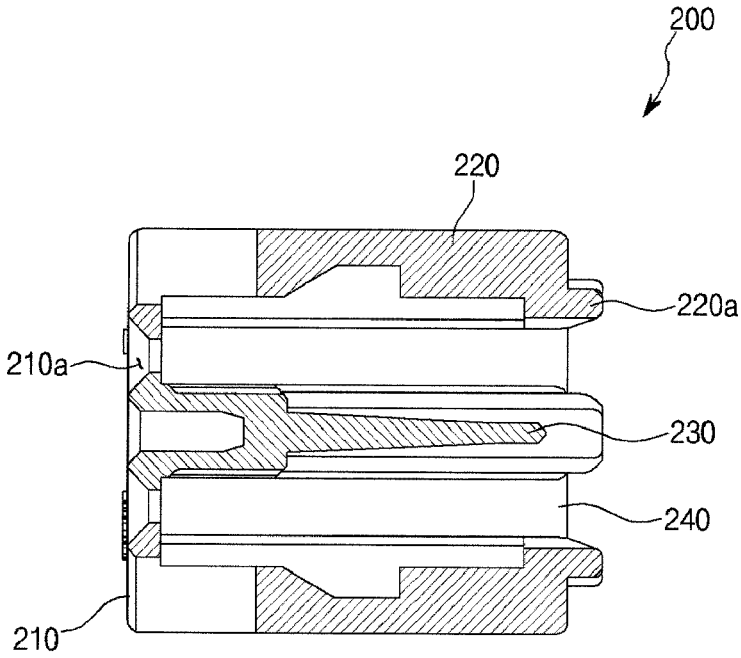

FIGS. 4 and 5 are a perspective view and a cross-sectional view of a front holder according to an embodiment of the present invention. A front holder 200 has a similar shape to a hexahedron and includes a front portion 210 and a plurality of second combining portions 220. Three insertion holes 210*a* are formed in upper and lower portions of the front portion 210, respectively, and total six three insertion holes 210*a* are formed in the front portion 210, wherein the number six of insertion holes 210*a* corresponds to the number of terminal-accommodating holes 120*a*. Three second combining portions 220 extend from the upper and lower portions of the front portion 210 to the rear of the front holder 200, respectively, and total six second combining portions 220 extend from the front portion 210, wherein the number six of second combining portions 220 corresponds to the number of first combining portions 130. Each of the second combining portions 220 includes a second securing protrusion 220*a* that is formed to correspond to the first securing protrusion 130*b* in an opposite direction to a direction in which the first securing protrusion 130*b* is formed, in such a way that the second groove h2 formed in the other side of the terminal T is secured on an end part of the second combining portion 220. The front holder 200 is closely adhered to one side of the opening 110 of the housing 100 and is inserted in the opening 110 towards the rear of the housing 100 and then is slid on the left or right side of the first combining portion 130 so that the terminal-accommodating holes 120*a* and the insertion holes 210*a* are aligned with one another, and thus, the front holder 200 is combined with the first combining portion 130. When the front holder 200 is slid on the left or right side of the first combining portion 130 in this way, the first securing protrusion 130*b* and the second securing protrusion 220*a* secure the first groove h1 and the second groove h2, respectively, and the front holder 200 is combined with the first combining portion 130.

Referring to FIG. 5, the terminal-accommodating holes 120*a* and the insertion holes 210*a* that correspond to one another, and the first combining portion 130 and the second combining portion 220 that correspond to one another are disposed in two stairs in a vertical direction, and the front holder 200 further includes the support portion 230 that is formed between the second combining portions 220 disposed in two stairs in a vertical direction, extends from the front portion 210 to the rear of the front holder 200 and supports a space formed between the first combining portions 130.

In addition, the first combining portion 130 includes a first lateral plate 131 disposed at one side of the first combining portion 130, and the front holder 200 includes a second lateral plate 240 disposed in an opposite direction to a direction in which the first lateral plate 131 is disposed. When the front holder 200 is slid on the first combining portion 130 in a lateral direction and is combined with the first combining portion 130, the first lateral plate 131 and the second lateral plate 240 are combined with each other as one body by protecting lateral sides of the first combining portion 130 and the front holder 200.

FIG. 6 is an exploded perspective view of an assembly of a female connector according to an embodiment of the present invention.

Referring to FIG. 6, the assembly of the female connector (FC) includes a front holder 100, a housing 200, and an inner seal 300. The inner seal 300 is inserted in an outer surface of the internal body 120, is pressurized by the front holder 200 and seals a space formed between the male connector (MC) and the outer surface of the internal body 120 to be waterproofed. In this way, when the assembly of the female connector (FC) includes the inner seal 300, the assembly of the female connector (FC) may be used as a waterproof connector.

Hereinafter, a method of securing the assembly of the female connector (FC) according to an embodiment of the present invention will be described below.

Figure 7:
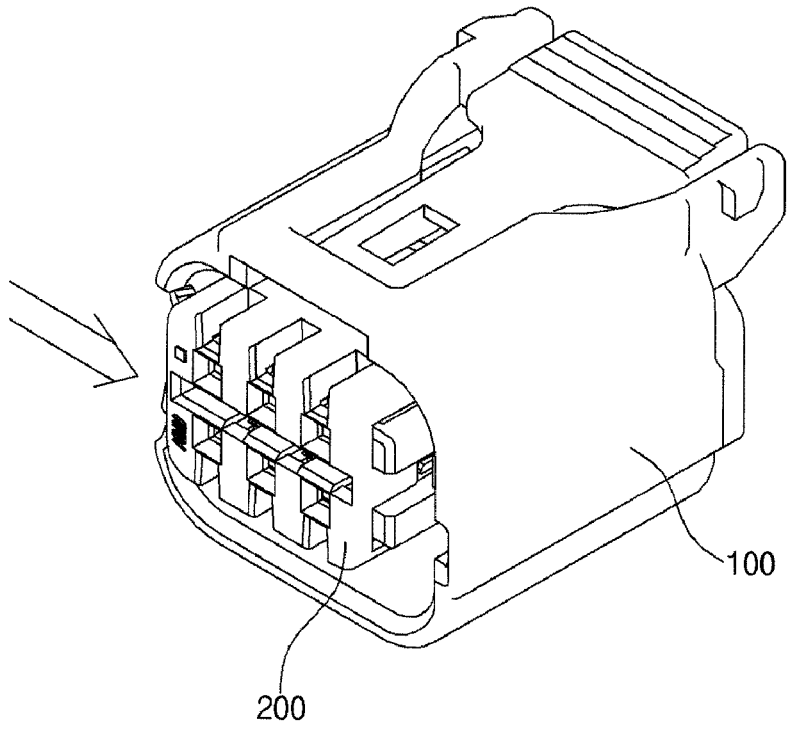
FIGS. 7 and 8 are a perspective view and a cross-sectional view of a primarily-secured assembly of a female connector according to another embodiment of the present invention.
Figure 8:
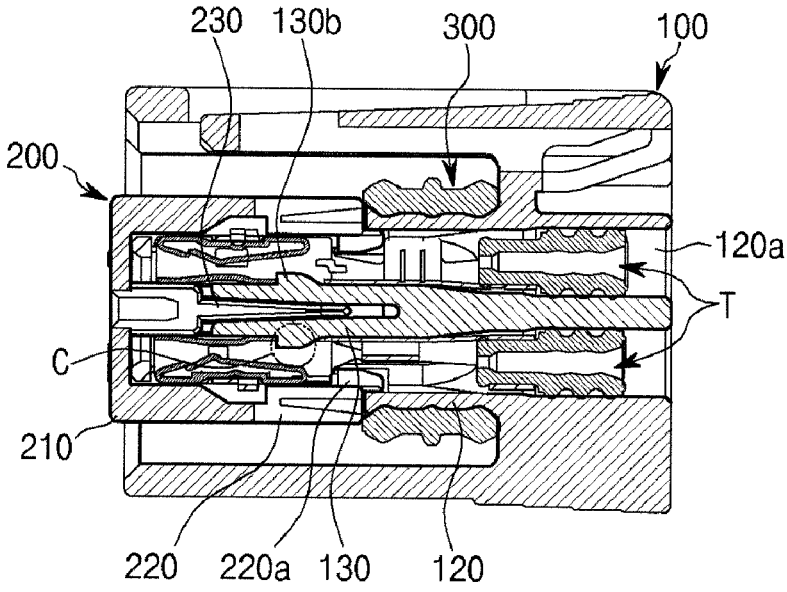
Figure 9:
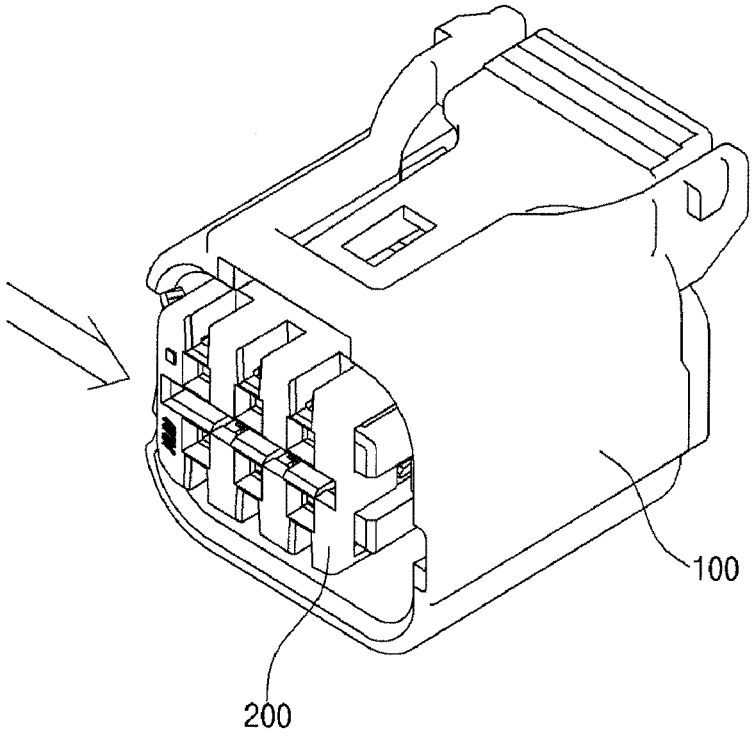
FIGS. 9 and 10 are a perspective view and a cross-sectional view of a secondarily-secured assembly of a female connector according to another embodiment of the present invention.
Figure 10:
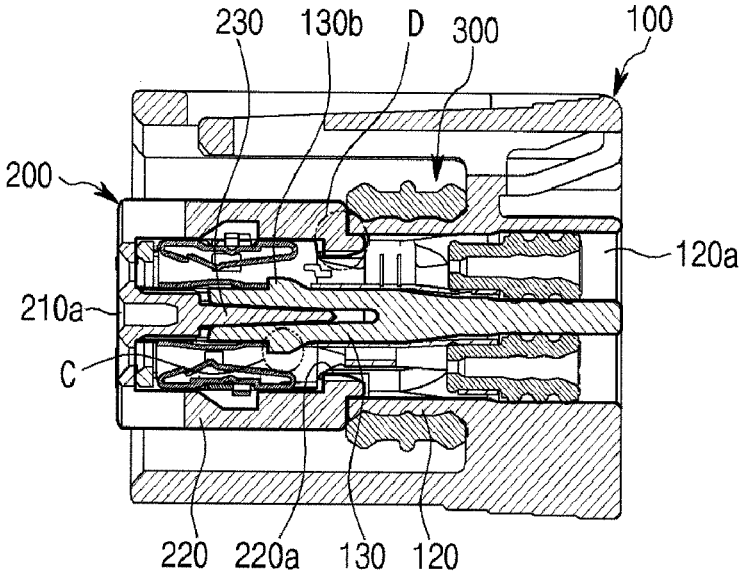

FIGS. 7 and 8 are a perspective view and a cross-sectional view of the primarily-secured assembly of the female connector (FC) according to another embodiment of the present invention, and FIGS. 9 and 10 are a perspective view and a cross-sectional view of the secondarily-secured assembly of the female connector (FC) according to another embodiment of the present invention.

Referring to FIGS. 7 and 8, in order to primarily secure the assembly of the female connector (FC), the second lateral plate 240 of the front holder 200 is inserted in an inside of the opening 110*a* when the second lateral plate 240 contacts an inner surface of the casing 110 and thus is primarily secured. Whether the second lateral plate 240 contacts the left or right side of the casing 110 depends on a user's need. When the assembly of the female connector (FC) is primarily secured, the second combining portion 220 and the support portion 230 temporarily secure the internal body 120 and the first combining portion 130, respectively. In addition, when the terminal T is inserted in each of the terminal-accommodating holes 120*a*, as marked by portion C in FIG. 6, the first groove h1 of the terminal T is secured by the first securing protrusion 130*b*; however, the second groove h2 is not secured by the second securing protrusion 220*a* because the front holder 200 has not been slid on the left or right side of the first combining portion 130 yet.

As illustrated in FIGS. 9 and 10, even when the assembly of the female connector (FC) is secondarily secured by sliding the front holder 200 in a right direction of the casing 110, the second combining portion 220 and the support portion 230 temporarily support the internal body 120 and the first combining portion 130, respectively. In this state, when only the front holder 200 is slid, the first groove h1 of the terminal T is secured by the first securing protrusion 130*b*, the second groove h2 of the terminal T is also secondarily secured by the second securing protrusion 220*a*, as marked by C and D in FIG. 10. If the terminal T is not properly inserted in each of the terminal-accommodating holes 120*a*, the front holder 220*a* is not slid in the right direction of the casing 110. Thus, it may be determined whether the terminal T is inserted in each of the terminal-accommodating holes 120*a* halfway, and the front holder 200 may serve as a terminal position assurance (TPA). In addition, since a direction in which the terminal T is inserted in each of the terminal-accommodating holes 120*a* is perpendicular to a direction in which the front holder 200 is slid in the right direction of the casing 100, the terminal T is not pushed when the front holder 200 is slid in the right direction of the casing 100.

Figure 11:
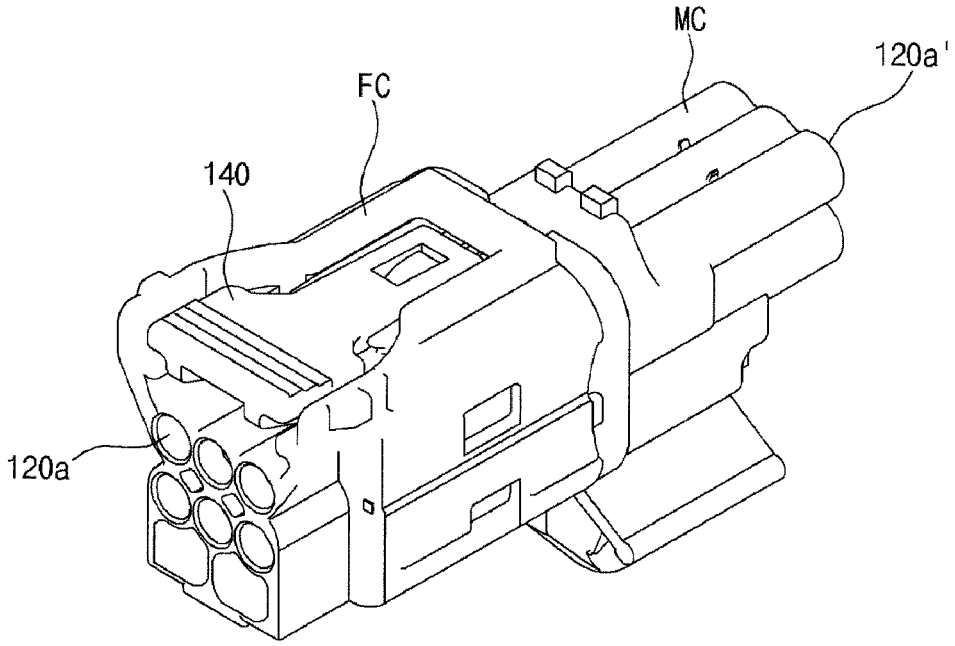
FIGS. 11 and 12 are a combined perspective view and a cross-sectional view of an assembly of a female connector and a male connector according to another embodiment of the present invention.
Figure 12:
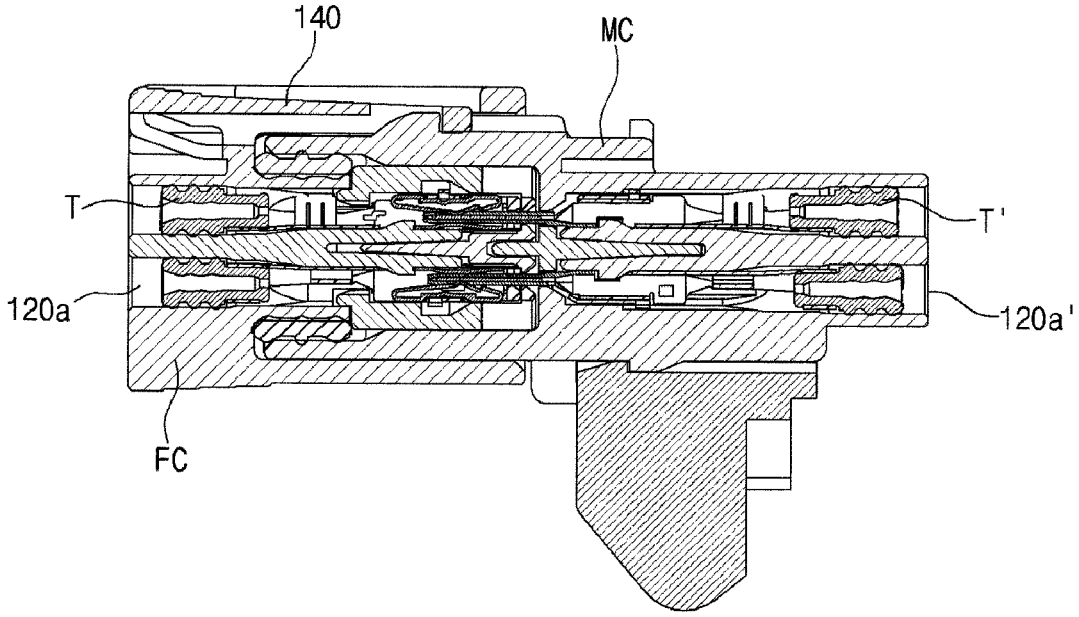

FIGS. 11 and 12 are a combined perspective view and a cross-sectional view of the assembly of the female connector (FC) and the male connector (MC) according to another embodiment of the present invention. After the assembly of the female connector (FC) and the terminal T, as described above, have been secondarily secured, they are combined with an assembly of the male connector (MC). In this case, the assembly of the male connector (MC) is engaged with the assembly of the female connector (FC) by using the male connector securing member 140 disposed at one side of the assembly of the female connector (FC), and one end of the assembly of the male connector (MC) is inserted in a space formed between the housing 100 and the front holder 200, and the inner seal 300 that is inserted in the outer surface of the internal body 120 is pressurized by the front holder 200 and seals a space formed between the male connector (MC) and the outer surface of the internal body 120 to be waterproofed.

In addition, a plurality of terminal-accommodating holes 120*a*' that correspond to the terminal-accommodating holes 120*a* of the assembly of the female connector (FC) are formed in the assembly of the male connector (MC), and a terminal T' is inserted in each of the terminal-accommodating holes 120*a*', and an end part of the terminal T' is inserted in each of the insertion holes 210*a* of the front holder 200. As a result, an electric current is applied between the terminal T' and the terminal T.

In this way, in the assembly of the female connector (FC) according to the present invention, the terminal T may be primarily secured by the first securing protrusion 130*b* that is disposed on the housing 100 and then may be secondarily secured by the second securing protrusion 220*a* by sliding the front holder 200 in left or right direction of the casing 100 so that the front holder 200 may serve as a TPA and the terminal T may be conveniently and stably secured. In addition, when the assembly of the female connector (FC) is manufactured in its primarily-secured state and is secondarily secured by sliding the front holder 200 on the spot, the number of processes is reduced, and workability is improved. In addition, when the inner seal 300 is used, the inner seal 300 is waterproof, and the air-tight state of the assembly of the female connector (FC) is maintained, and short that is a main defect in applying an electric current may be prevented from occurring due to terminal detachment or shake.

The invention claimed is:

1. An assembly of a female connector, comprising:

a housing comprising a casing having an opening formed in front of the casing so that a male connector is inserted in the opening, an internal body that comprises one or more terminal-accommodating holes formed in the internal body and protrudes from a rear side of the casing towards a front of the housing, and a plurality of first combining portions that extend from the internal body to the front of the housing, each of the plurality of first combining portions comprising an extension groove formed in one side of each first combining portion so as to communicate with the one or more terminal-accommodating holes, wherein a first securing protrusion is disposed in the extension groove, and a first groove that is formed in one side of a terminal inserted through the one or more terminal-accommodating holes is secured in the first securing protrusion; and a front holder comprising a front portion having the number of a plurality of insertion holes corresponding to the number of the one or more terminal-accommodating holes formed in the front portion and a plurality of second combining portions corresponding to the number of the first combining portions that extend from the front portion towards a rear of the front holder, comprise a second securing protrusion that is formed to correspond to the first securing protrusions in an opposite direction to a direction in which the first securing protrusion is formed, in such a way that a second groove formed in the other side of the terminal is secured on an end part of each second combining portion, wherein, when the front holder is inserted in the opening and then is slid on a left or right side of each first combining portion so that the terminal-accommodating holes and the plurality of insertion holes are aligned with one another, the first securing protrusion and the second securing protrusion secure the first groove and the second groove, respectively, and the front holder is combined with the first combining portion.

2. The assembly of the female connector of claim 1, further comprising an inner seal that is inserted in an outer surface of the internal body, is pressurized by the front holder and seals a space formed between the male connector and the outer surface of the internal body to be waterproofed.

3. The assembly of the female connector of claim 1, wherein two or more terminal-accommodating holes and two or more insertion holes that correspond to one another, and two or more first combining portions and two or more second combining portions that correspond to one another are disposed in two stairs in a vertical direction, and the front holder further comprises a support portion that is formed between the second combining portions disposed in two stairs in a vertical direction, extends from the front portion to the rear of the front holder and supports a space formed between the first combining portions.

4. The assembly of the female connector of claim 1, wherein each of the first combining portions further comprises a first lateral plate disposed at one side of the first combining portion, and the front holder further comprises a second lateral plate disposed in an opposite direction to a direction in which the first lateral plate is disposed, and when the front holder is slid on the left or right side of the first combining portion and is combined with the first combining portion, the first lateral plate and the second lateral plate protect lateral sides of the first combining portion and the front holder.

5. The assembly of the female connector of claim 2, wherein each of the first combining portions further comprises a first lateral plate disposed at one side of the first combining portion, and the front holder further comprises a second lateral plate disposed in an opposite direction to a direction in which the first lateral plate is disposed, and when the front holder is slid on the left or right side of the first combining portion and is combined with the first combining portion, the first lateral plate and the second lateral plate protect lateral sides of the first combining portion and the front holder.

6. The assembly of the female connector of claim 3, wherein each of the first combining portions further comprises a first lateral plate disposed at one side of the first combining portion, and the front holder further comprises a second lateral plate disposed in an opposite direction to a direction in which the first lateral plate is disposed, and when the front holder is slid on the left or right side of the first combining portion and is combined with the first combining portion, the first lateral plate and the second lateral plate protect lateral sides of the first combining portion and the front holder.

* * * * *